US007076076B2

(12) United States Patent
Bauman

(10) Patent No.: US 7,076,076 B2
(45) Date of Patent: Jul. 11, 2006

(54) HEARING AID SYSTEM

(75) Inventor: Natan Bauman, Cheshire, CT (US)

(73) Assignee: Vivatone Hearing Systems, LLC, Shelton, CT (US)

( * ) Notice: Subject to any disclaimer, the term of this patent is extended or adjusted under 35 U.S.C. 154(b) by 98 days.

(21) Appl. No.: 10/241,279

(22) Filed: Sep. 10, 2002

(65) Prior Publication Data

US 2004/0047481 A1 Mar. 11, 2004

(51) Int. Cl.
*H04R 25/00* (2006.01)

(52) U.S. Cl. ..... 381/328; 381/322

(58) Field of Classification Search ..... 381/23.1, 381/60, 72, 312, 317, 322, 324, 380, 382, 381/383; 181/129, 130, 131, 135; 128/864, 128/865, 867, 868; 439/8, 17
See application file for complete search history.

(56) References Cited

U.S. PATENT DOCUMENTS 2,363,175 A * 11/1944 Grossman ..... 381/322
4,539,440 A * 9/1985 Sciarra ..... 381/329
5,420,930 A * 5/1995 Shugart, III ..... 381/315
5,572,594 A * 11/1996 Devoe et al. ..... 381/328
5,654,530 A * 8/1997 Sauer et al. ..... 181/130
5,721,783 A * 2/1998 Anderson ..... 381/328
5,920,636 A * 7/1999 Oliveira et al. ..... 381/328
5,987,146 A * 11/1999 Pluvinage et al. ..... 381/328
6,039,685 A * 3/2000 Bushek ..... 381/322
6,094,493 A * 7/2000 Borowsky et al. ..... 381/328
6,367,578 B1 * 4/2002 Shoemaker ..... 181/135
6,748,094 B1 * 6/2004 Tziviskos et al. ..... 381/330
2004/0010181 A1 * 1/2004 Feeley et al. ..... 381/312

* cited by examiner

*Primary Examiner*—Sinh Tran
*Assistant Examiner*—Brian Ensey
(74) *Attorney, Agent, or Firm*—Cantor Colburn, LLP

(57) ABSTRACT

The present invention relates to a system for improving a user's hearing and more particularly to a receiver system used in the system. In one embodiment, the receiver system has a housing and a plurality of arms extending from the housing for positioning and suspending the receiver within the ear canal of a user. Each of the arms may be formed from a flexible, plastic material or a bendable wire. In a second embodiment, the receiver system is surrounded by a disc formed from a sound filtering material. When installed in a hearing aid system, the receiver is separated from the microphone. When installed in a tinnitus/hyperacusis device, the receiver is separated from the body of the instrument.

3 Claims, 2 Drawing Sheets

HEARING AID SYSTEM

BACKGROUND OF THE INVENTION

The present invention relates to a hearing aid system and in particular to a receiver system used in the hearing aid system.

A wide variety of hearing aid units are known in the art. In some units, the receiver is positioned within the ear canal in such a way that it creates an occlusion effect. Further, the receiver is encased within the body of the hearing aid. In most cases whether the hearing aid is fitted in the ear, as a custom made instrument, or as an instrument which is placed behind the ear, an occlusion problem exists. This often is a cause of rejection of the amplification due to patient's discomfort with their own voice. This occlusion effect is associated with the sensation of feeling that the patient's head is "at the bottom of the barrel" with the patient's own voice becoming intolerably loud. Placing an earmold or a shell of a custom made hearing aid can produce an additional low frequency amplification of the patient's own voice up to 20 to 30 dB. This can, therefore, be responsible for a four times perceived loudness increase in the patient's own voice. In order to eliminate the occlusion effect, an open ear canal amplification is applied. However, the acoustics of an open ear fitting increase the risk of acoustic feedback prohibiting in most instances to achieve a peak gain of more than 30 dB.

Thus, there is a need for an improved hearing aid system which avoids the occlusion effect and which also avoids feedback, especially during high frequency amplification.

SUMMARY OF THE INVENTION

Accordingly, it is an object of the present invention to provide a receiver, receiver placement, and a receiver casing which avoids the occlusion effect.

It is a further object of the present invention to provide a receiver system which helps avoid feedback during high frequency amplification.

It is a further object of the present invention to provide a hearing aid system having a receiver, such as the aforementioned receiver, separated from the microphone.

The foregoing objects are attained by the receiver and the hearing aid system of the present invention.

In accordance with the present invention, a receiver and a receiver casing for use in a system for improving a user's hearing, in a hearing aid system is provided. Also, it is the intention to use same receiver system removed from the body of the instrument to be used in a tinnitus device as described in U.S. Pat. No. 6,048,305. It is essential to have an open ear tinnitus instrument in the tinnitus retraining therapy program. Therefore, this present invention will provide such by having the body of the instrumentation placed behind the ear with the receiver placed in the ear canal without obstructing the external auditory means.

In a first embodiment, the receiver comprises a housing to be positioned within an ear canal and a plurality of arms extending from the housing. The tip portion of each arm contacts a surface of a user's ear canal and suspends the receiver within the ear canal.

In a second embodiment, the receiver is housed in a disc. The disc is formed from a frequency specific filtering material. The disc has an adjustable rim which when placed in the ear canal uses spring like motion to maintain receiver position.

Further, in accordance with the present invention, a hearing aid system is provided. The hearing aid system comprises a microphone located externally of a user's ear canal, an amplifier connected to the microphone to amplify sounds received by the microphone, a receiver positioned within the user's ear canal, and means for transmitting the amplified output to the receiver. As before, the receiver preferably has a housing and a plurality of arms extending from the housing for suspending the receiver within the user's ear canal. Alternatively, the receiver may be housed within a disc structure.

Other details of the hearing aid system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
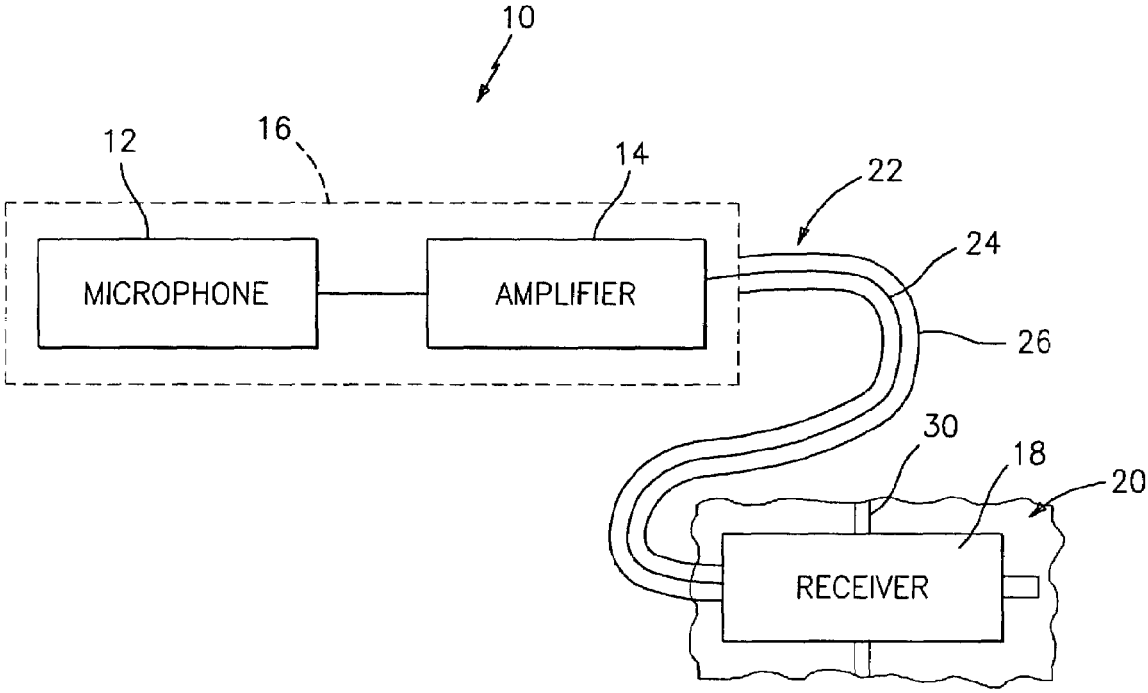
FIG. 1 is a schematic representation of a hearing aid system.

Referring now to the drawings, FIG. 1 illustrates a hearing aid system 10 in accordance with one aspect of the present invention. The hearing aid system 10 includes a microphone 12 and an amplifier 14. The microphone 12 and the amplifier 14 are positioned within a housing 16. The housing 16 may form part of a behind-the-ear unit, part of a unit installed within a user's eyeglass frame, or part of a unit installed within a headset. The hearing aid system 10 may further include a battery (not shown) and means for controlling the hearing aid such as a volume control.

The hearing aid system 10 further includes a receiver 18 which is separated from the housing containing the microphone. The receiver is installed and suspended within the ear canal 20 of a user and means 22 for transmitting amplified output from the amplifier 14 to the receiver 18. The sound transmitting means 22, depending upon the particular kind of amplifier 14 being used, may be a wire 24 encased within a plastic coating 26 housing the wire. When used, the wire 24 makes an electrical contact with the amplifier 14 and the receiver 18 over which electrical output can be transmitted. The plastic coating around the wire 24 helps prevent electrical shocks.

Figure 6:
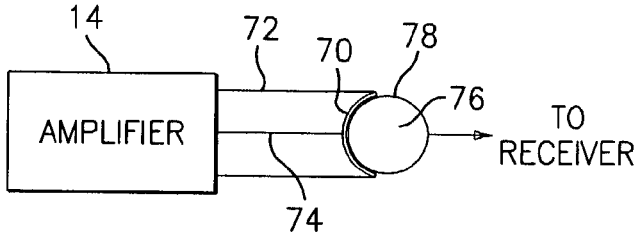
FIG. 6 illustrates a system for connecting the output of an amplifier to a receiver.

An alternative way of connecting the output from the amplifier 14 to the receiver 18 is shown in FIG. 6. In this approach, there is an arcuately shaped electric contact 70 attached to the amplifier 14 by supports 72. A wire 74 extends between amplifier 14 and the contact 70. The electrical contact 70 is shaped in the manner of a ball socket to receive a ball 76. The ball 76 has an electrical coating on its outer surface 78 and a wire 80 which attaches to the receiver 18.

The microphone 12, the amplifier 14, and the control means may comprise any suitable microphone, amplifier, and control means known in the art. Similarly, the receiver 18 may comprise any suitable receiver known in the art.

Figure 2:
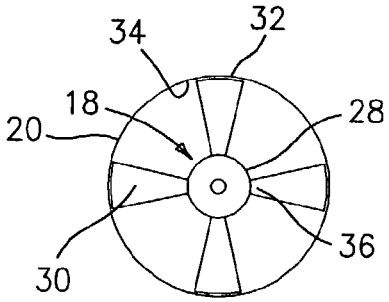
FIG. 2 is a front view of a suspended receiver used in the hearing aid system of FIG. 1.
Figure 3:
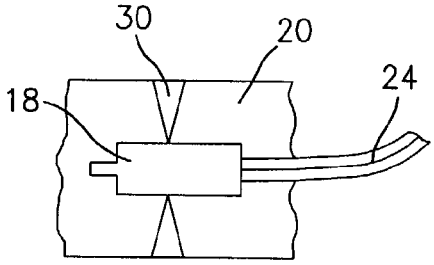
FIG. 3 is a side view of the receiver of FIG. 2 positioned within a user's ear canal.

As shown in FIGS. 2 and 3, the receiver 18 has a housing 28. To position and suspend the receiver 18 within the ear canal 20, a plurality of arms 30 extend from the housing 28. Each of the arms 30 is formed from a flexible material such as a flexible plastic material. The tip portions 32 of each arm 30 contact a surface 34 of the ear canal 20 to position the receiver 18 in a desired location in the ear canal 20. As can be seen from FIG. 2, each arm 30 tapers from the tip portion 32 to a base portion 36. In a preferred embodiment of the present invention, the arms 30 are spaced 90 degrees from each other.

The arms 30 are quite advantageous because they allow the receiver 18 to be positioned or suspended in such a way that the receiver 18 does not occlude the ear canal. Further, the arms 30 allow the use of any size of receiver in the hearing aid systems. Still further, the receiver, separated from the microphone, provides a greater flexibility in delivering high frequency amplification without causing or creating feedback. Thus, protection of the ear canal and the separation of the receiver 18 from the microphone 12 allows one to achieve greater high frequency gain without feedback.

Further, a suspended receiver away from the ear canal walls will also provide a better protection from impacting the receiver with cerumen.

While it has been stated that the microphone 12 and the amplifier 14 are in the same housing, it should be noted that they could be in separate housings depending upon the type of hearing aid system 10. For example, if the system 10 is incorporated in an eyeglass frame, the microphone could be in one part of the frame and the amplifier could be in another part of the frame.

Figure 4:
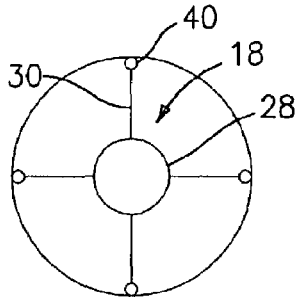
FIG. 4 illustrates an alternative embodiment of a suspended receiver in accordance with the present invention.

While it is preferred to form the arms 30 from a flexible plastic material, each of the arms 30 could also be formed from a bendable wire. When formed from a bendable wire, as shown in FIG. 4, each wire may have a plastic or metal ball 40 at the end which makes contact with a surface of the user's ear canal.

If desired, the length of the insertion of the receiver 18 in the ear canal 20 can be adjusted using a retractable wire 24 from the sound transmitting means 22 or by replacing the ear hook on a behind the ear hearing aid unit.

Figure 5:
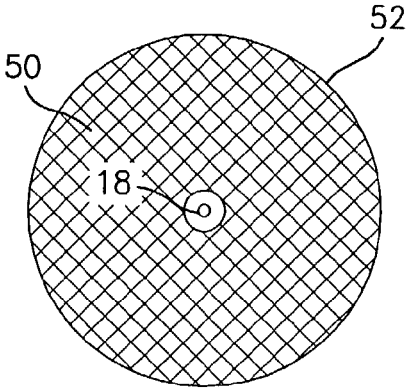
FIG. 5 illustrates an embodiment of a receiver housed in a disc.

Referring now to FIG. 5, an alternative receiver embodiment is illustrated. The receiver 18 is housed within a disc 50 of exchangeable sound filtration material. The material forming the disc 50 may be formed from a paper or fabric like material which is transparent to most sound except sound which is to be filtered out. By making the disc 50 exchangeable or replaceable, one can mechanically change the frequency response of sounds that are escaping out of the hearing aid. One can also filter out any frequency that causes feedback. The disc 50 is preferably formed with a rim 52 that flexes, such as a rim formed from a spring-like material, in order to maintain the position of the receiver 18 and disc 50 in a desired position in the ear canal.

Figure 7:
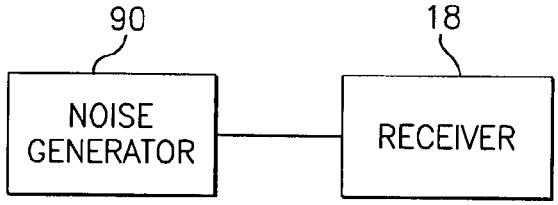
FIG. 7 is a schematic representation of a tinnitus/hyperacusis treatment system.

While the receiver 18 of the present invention has been described in the context of hearing aid systems, the receiver could also be used in tinnitus treatment systems. For example, as shown in FIG. 7, a noise generator 90 may be positioned behind the wearer's ear in lieu of the microphone or amplifier and attached to a receiver 18 positioned within the user's ear canal. The noise generator 90 generates sounds to be transmitted to the tympanic membrane for the treatment of tinnitus/hyperacusis. The receiver 18 may have a disc 50 surrounding it or a plurality of arms 30 radiating from it in order to position it within the ear canal. The disc 50 and the arms 30 may have the structure described hereinbefore.

It is apparent that there has been provided in accordance with the present invention a hearing aid system which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A receiver for use in a system for improving a user's hearing comprising a housing to be positioned within an ear canal in an open ear configuration, said housing having a plurality of arms extending from said housing, and a tip portion of each of said arms contacting said ear canal to suspend the receiver in the ear canal, wherein each said arm is formed from a bendable wire.

2. A hearing aid system comprising a microphone located externally of an ear canal of a user, an amplifier connected to said microphone for amplifying sounds received from said microphone, a receiver positioned within said user ear canal, and a means for transmitting amplified sound from said amplifier to said receiver, which is positioned in an open ear configuration, wherein said receiver has a housing and a plurality of arms extending from said housing, said arms contacting said user ear canal to position said receiver within said ear canal, wherein each of arms is formed from a bendable wire.

3. A hearing aid system comprising a microphone located externally of an ear canal of a user, an amplifier connected to said microphone for amplifying sounds received from said microphone, a receiver positioned within said user ear canal, and a means for transmitting amplified sound from said amplifier to said receiver, wherein said receiver has a housing and a plurality of arms extending from said housing, said arms contacting said user ear canal to position said receiver within said ear canal, wherein each of said arms is formed from a bendable wire and wherein each said wire has a ball at an end making contact with a surface of the user's ear canal.

* * * * *